US006050048A

United States Patent [19]

Hellsten

[11] Patent Number: 6,050,048

[45] Date of Patent: Apr. 18, 2000

[54] BEAM

[75] Inventor: Mikael Hellsten, Falkenberg, Sweden

[73] Assignee: Balcus AB, Tranas, Sweden

[21] Appl. No.: 09/035,842

[22] Filed: Mar. 6, 1998

Related U.S. Application Data

[63] Continuation-in-part of application No. 08/836,178, Apr. 23, 1997, Pat. No. 5,778,626.

[30] Foreign Application Priority Data

Sep. 7, 1995 [SE] Sweden ..... 9503074

[51] Int. Cl.[7] ..... E04C 3/09

[52] U.S. Cl. ..... 52/731.3; 52/670; 52/732.2

[58] Field of Search ..... 52/670, 731.3, 52/732.2

[56] References Cited

U.S. PATENT DOCUMENTS

| | | | |
|---|---|---|---|
| 1,656,810 | 1/1928 | Arnstein . | |
| 2,753,962 | 7/1956 | McBerty | 52/731.3 X |
| 3,108,406 | 10/1963 | Ellis . | |
| 3,282,005 | 11/1966 | Birdwell . | |
| 3,503,164 | 3/1970 | Berry et al. | 52/731.3 X |
| 3,812,558 | 5/1974 | Watanabe . | |
| 4,305,187 | 12/1981 | Iwamura et al. . | |
| 4,968,185 | 11/1990 | Leibhard et al. | 52/670 X |
| 5,778,626 | 7/1998 | Hellsten | 52/731.2 |

*Primary Examiner*—Christopher T. Kent
*Attorney, Agent, or Firm*—Young & Thompson

[57] ABSTRACT

An elongate beam that is constructed of a sheet metal having expanded metal sections. The beam has a closed profile that has at least two side sections at least one of which includes expanded metal. The opposite side edges of the sheet metal are connected to one another so that the sheet metal forms a closed beam structure.

13 Claims, 25 Drawing Sheets

BEAM

This application is a continuation-in-part of U.S. application Ser. No. 08/836,178, filed Apr. 23, 1997, now U.S. Pat. No. 5,778,626.

TECHNICAL FIELD

The present invention relates to a beam with a fully closed profile at least some sides of which have expanded metal sections.

BACKGROUND ART

A considerable need exists in many technical areas for beams of low weight, high strength with regard to both resistance to bending and resistance to compression, and advantageous collapse characteristics. Such beams are desirable in the vehicle industry, the construction industry, the road equipment industry etc., and especially the passenger car industry, since an advantageous weight-to-strength ratio permits lower fuel consumption and advantageous collapse characteristics or a considerable capacity to absorb high energy in the course of deformation to a state in which the beam may be regarded as having collapsed. This latter characteristic is desirable in so-called impact protection zones in passenger cars, buses and lorries or similar vehicles.

DISCLOSURE OF THE INVENTION

It is an object of the present invention to provide a beam which satisfies the aforementioned requirements.

This problem is solved in accordance with the present invention by providing a beam which is profiled from a single sheet of coiled sheet metal strip which exhibits an elongated section of expanded metal along at least one side of the finished profile. The sections of the sheet metal strip connecting the sides of the beam are unbroken and both meeting edges of the sheet metal strip are connected or attached to one another to form the elongated closed profile. A plurality of such elongated beams may be provided as subcomponents which are connected together to form a single beam structure as described herein.

The two meeting edges of the beam may be connected to one another by folding the unbroken edge sections. Alternatively, the two meeting edges may be connected to one another by welding. Although not necessary, it is advantageous for the corner sections of the beam to be unbroken and for the fold or other connection closing the profile to be situated at one of the corners in adjacent unbroken edge sections. The beam may be profiled from a sheet metal strip which exhibits an elongated section of expanded metal on each side of the finished profile and an elongated section of sheet metal strip at each corner.

A beam in accordance with the present invention provides unimagined opportunities within many technical areas, where components can be made appreciably lighter without in any way having to jeopardize the strength of the component in question. Appreciably improved energy-absorbing characteristics are also offered, since appreciably greater energy is consumed or required to bring about the complete collapse of a beam in accordance with the present invention than in the case of conventional beam structures. A beam in accordance with the present invention also permits economies of both space and weight, which in turn lead to appreciably better operating economy. A beam in accordance with the present invention also permits the use of simpler and more efficient installation and assembly methods.

BRIEF DESCRIPTION OF THE DRAWINGS

This invention may be clearly understood by reference to the attached drawings wherein like elements are designated by like reference numerals and in which.

BEST MODE FOR CARRYING OUT THE INVENTION

Figure 1:
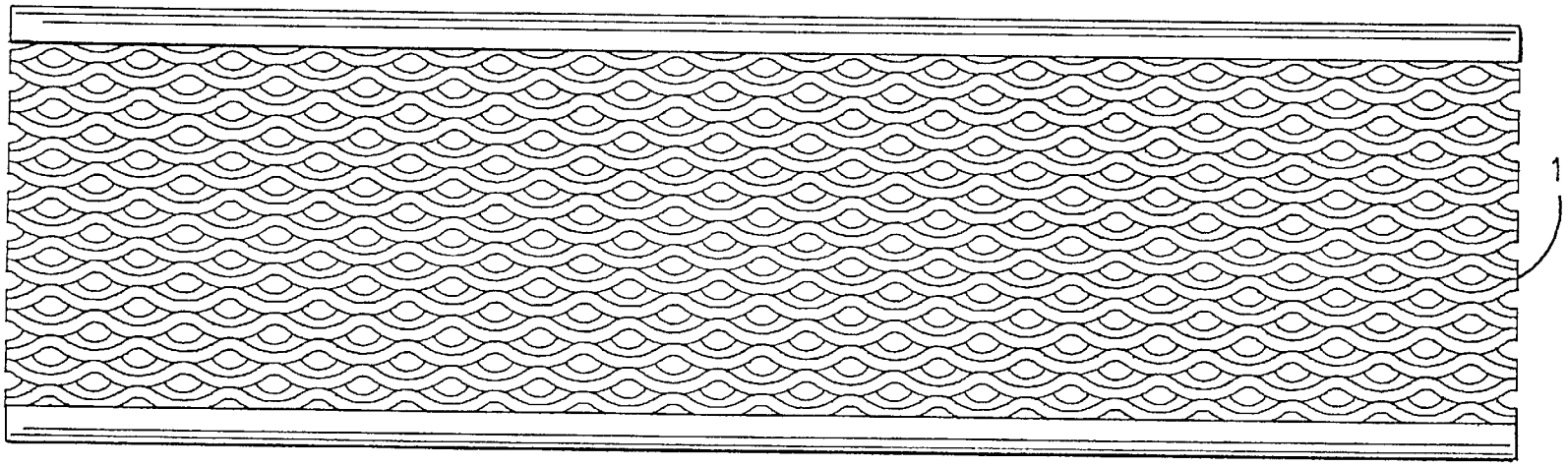
FIG. 1 is an elevational view of a side of a preferred embodiment of the beam of the present invention.

For a better understanding of the present invention, together with other and further objects, advantages and capabilities thereof, reference is made to the following disclosure and appended claims taken in conjunction with the above-described drawings.

The embodiments of a beam in accordance with the present invention shown in the drawings are particularly suited for achieving the objects of this invention. The embodiments of such beams illustrated in the drawings may in principle be of infinite length. A beam in accordance with the present invention may exhibit any suitable profile. For example, a quadrilateral and essentially square profile may be provided. Other examples may include a two-sided oval profile or elliptical profile, any other quadrilateral profile, a quadrangular profile, a three-sided profile and many variants and combinations of such profiles. It is conceivable, for example, to have a profile which consists in principle of a number of triangular profiles, for example three triangular profiles or even four triangular profiles, which are attached or connected to one another in an appropriate fashion, for example with their tips meeting one another. Quadrangular profiles need not be square, of course, but may exhibit in principle any quadrangular form. The angles in the quadrilateral profiles need not be 90°, but may be angles other than right-angles.

Figure 2:
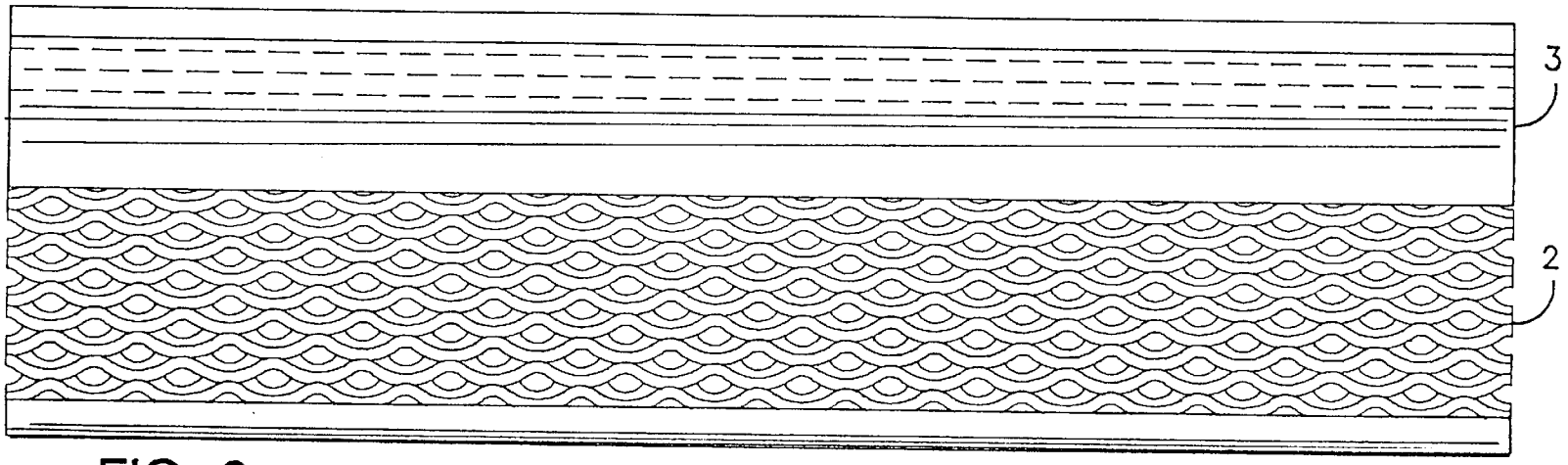
FIG. 2 is an elevational view of another side of the embodiment shown in FIG. 1.
Figure 3:
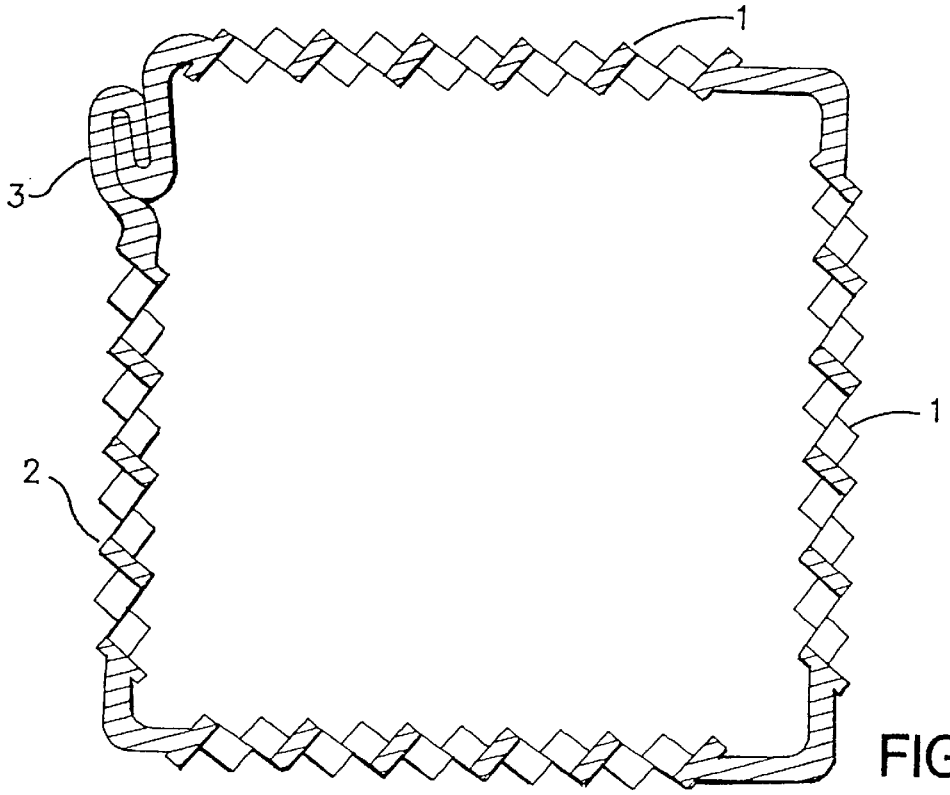
FIG. 3 is a cross-sectional view of the present invention.

The beam illustrated in FIGS. 1 to 3 of the drawings has a quadrilateral and essentially square profile formed from a single sheet of coiled sheet metal. As illustrated in FIG. 3, the beam has a section 1 of expanded metal on each of the three sides and a section 2 of expanded metal on the fourth side. The fourth side also exhibits a folded section 3 of essentially conventional type. The profile exhibits unbroken sections between the sides; that is, solid portions that are part of the single sheet of coiled sheet metal from which the profile is fabricated. The folded section 3 engages in an essentially conventional fashion in two meeting, unbroken edge sections that are obtained after profiling of the beam to the quadrangular form shown.

The folded section 3 may be replaced by some other form of connection or folding. For example, a weld in the form of a spot weld or a seam weld may replace the folded connection 3. Alternatively, the folded connection 3 may also be welded. The choice of connection or attachment depends largely on the choice of material used for the metal strip.

Figure 4:
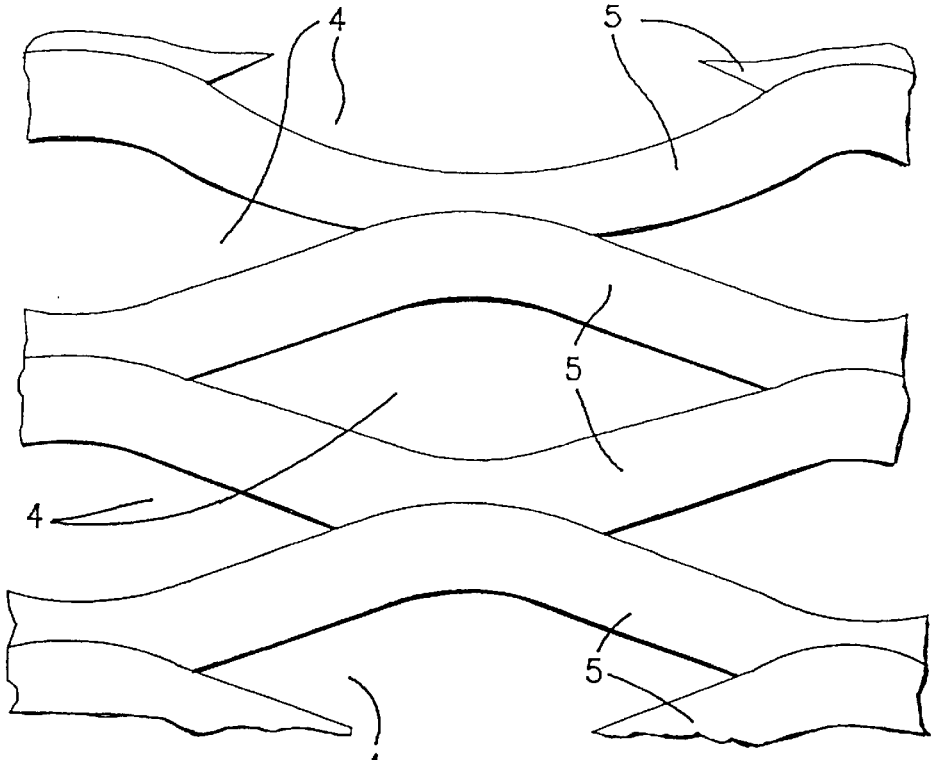
FIG. 4 is a detailed view of a section of the expanded metal depicted in FIGS. 1 to 3.
Figure 5:
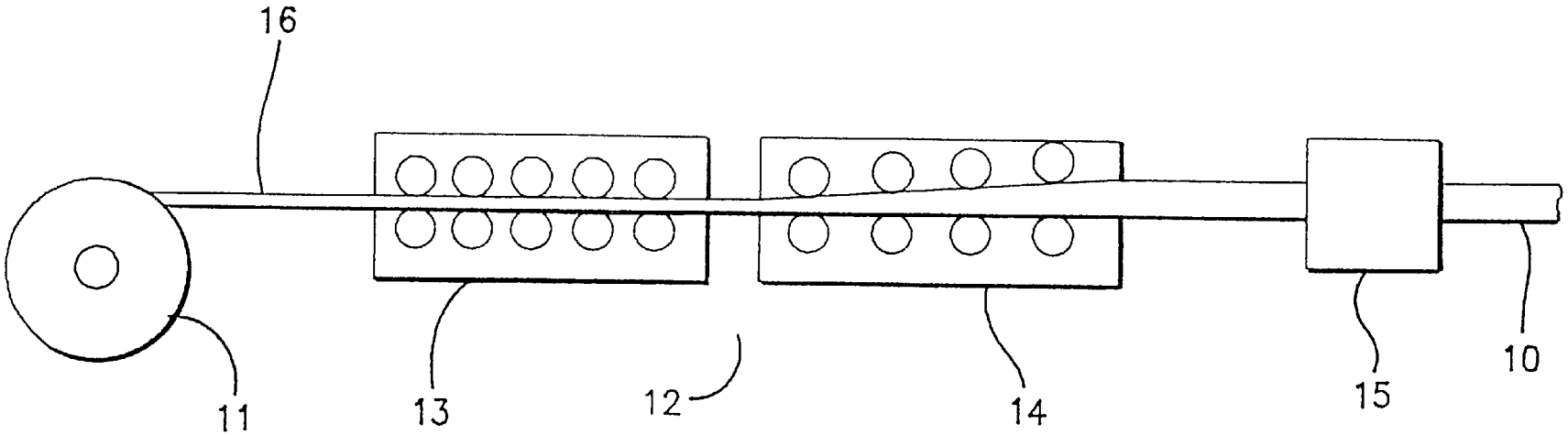
FIG. 5 is a schematic view of a manufacturing process to make the beam of the present invention.

FIG. 4 illustrates a part of the sections 1, 2 of expanded metal in detail, and it can be appreciated from this detailed Figure that the sections of expanded metal have a conventional form with a number of holes between bridges or connections 5 in the sheet metal itself to form the expanded metal generally designated 6.

It is also possible, of course, to have other types of expanded metal structures, although the type illustrated in FIG. 4 is the preferred type. It must be pointed out in this respect that the upward-facing curves in the bridges 5 are displaced up and out of the plane of the drawing, whereas the downward-facing curves of the bridges 5 are displaced inwards and into the plane of the drawing, although they are connected to one another in such a way that the upward-facing curve is connected to the downward-facing curve.

FIGS. 6 through 23 are diagrammatic representations which illustrate alternate embodiments of the beam of the present invention, specific illustrations of examples of the elements referred to herein with respect to FIGS. 6 through 23 being illustrated in FIGS. 1 to 3. For example, FIGS. 1 to 3 illustrate an example of the expanded metal, connecting folding sections and unbroken sections of the embodiments schematically illustrated in FIGS. 6 through 23. The embodiments of FIGS. 6 through 23 illustrate alternative profiles of the beam of the present invention. The beams illustrated in FIGS. 6 through 23 are by way of example, the present invention not being limited to the embodiments described herein. In each of the beams of FIGS. 6 through 23, the sides of the beams which include expanded metal may be fabricated from expanded metal of the type described herein and designated by reference number 6 in FIG. 4, such expanded metal being depicted schematically in FIGS. 6 through 23. Such expanded metal is by way of example only.

Figure 6:
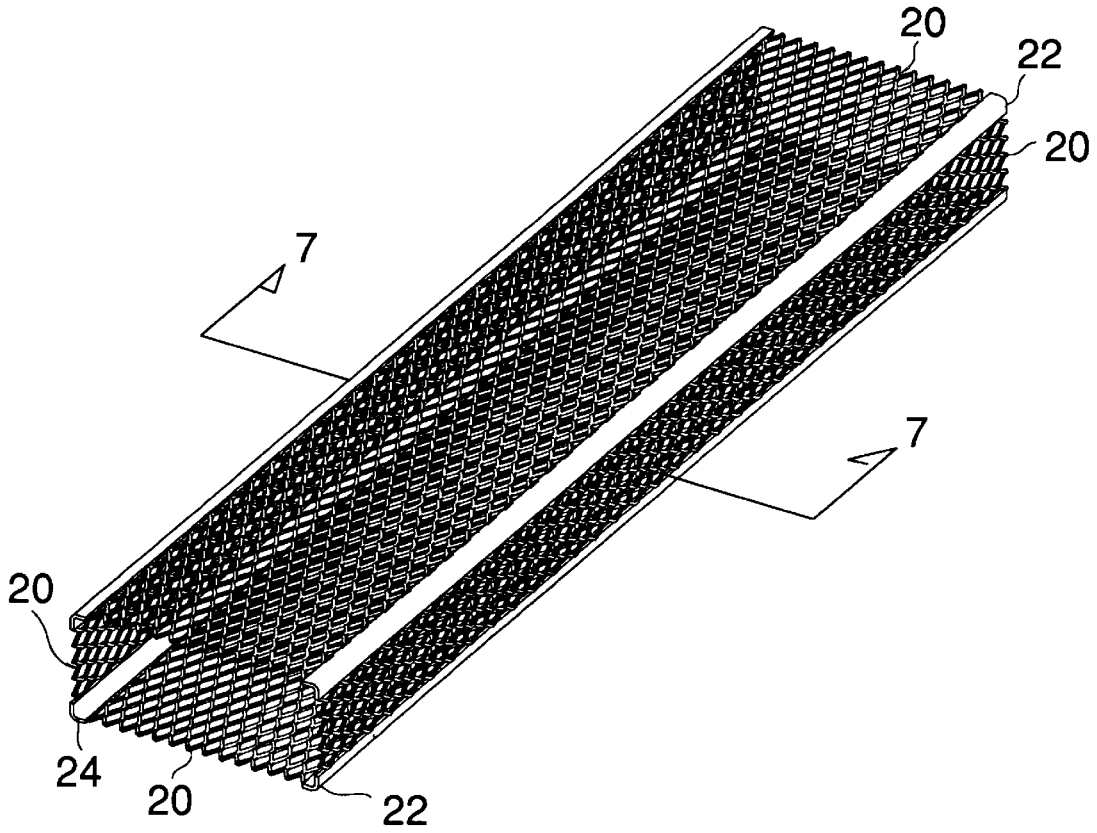
FIG. 6 is a perspective view of an alternative embodiment of the beam of the present invention.
Figure 7:
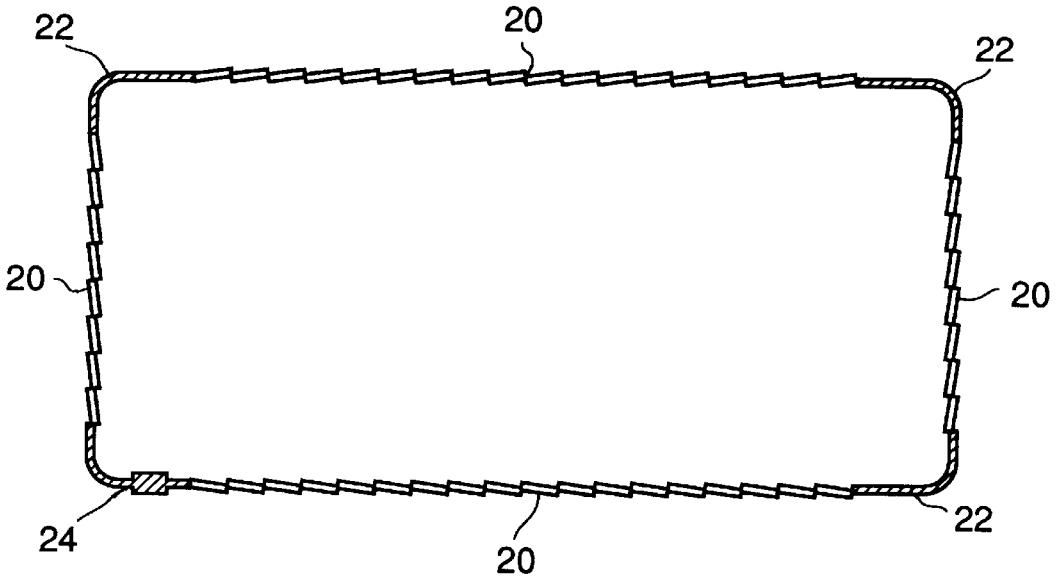
FIG. 7 is a cross-sectional view of FIG. 6 taken along lines 7—7.

FIGS. 6 and 7 illustrate an elongate member coiled from a single piece of sheet metal. The member includes side sections 20 which are integrally attached to each other at respective solid portions 22 in a manner similar to the manner in which the side sections of FIGS. 1 to 3 are integrally attached to each other at respective solid portions. Two of the side sections 20 include respective side edges which are connected at 24 in a manner similar to the folded section 3 of FIG. 3 to form a closed rectangular profile. In the embodiment of FIGS. 6 and 7, all of the side sections include expanded metal. Although not necessary, in the embodiment illustrated in FIGS. 6 and 7, the side edges are attached at 24 at a corner of the quadrilateral profile.

Figure 8:
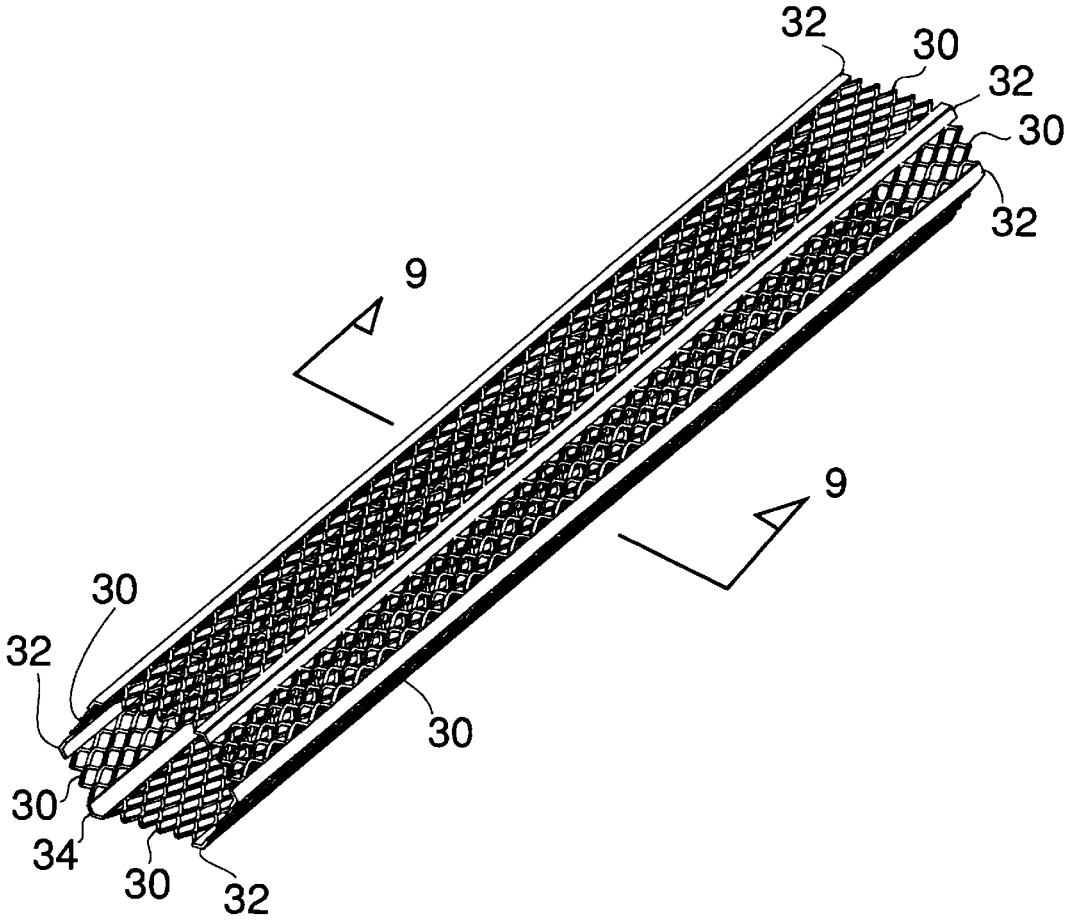
FIG. 8 is a perspective view of another alternative embodiment of the beam of the present invention.
Figure 9:
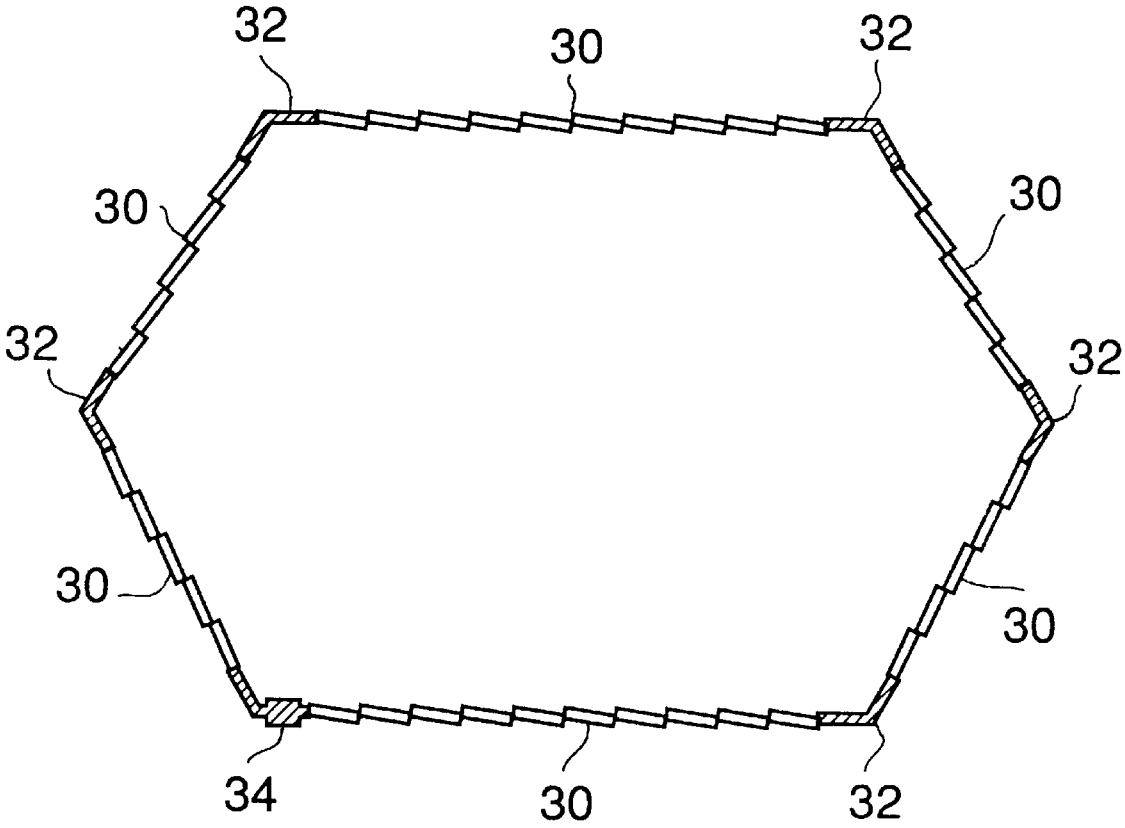
FIG. 9 is a cross-sectional view of FIG. 8 taken along lines 9—9.

FIGS. 8 and 9 illustrate an elongate member coiled from a single piece of sheet metal. The member includes side sections 30 which are integrally attached to each other at respective solid portions 32 in a manner similar to the manner in which the side sections of FIGS. 1 to 3 are integrally attached to each other at respective solid portions. Two of the side sections 30 include respective side edges which are connected at 34 in a manner similar to the folded section 3 of FIG. 3 to form a closed hexagonal profile. In the embodiment of FIGS. 8 and 9 all of the side sections include expanded metal and the side edges are attached at 34 at a corner of the profile.

Figure 10:
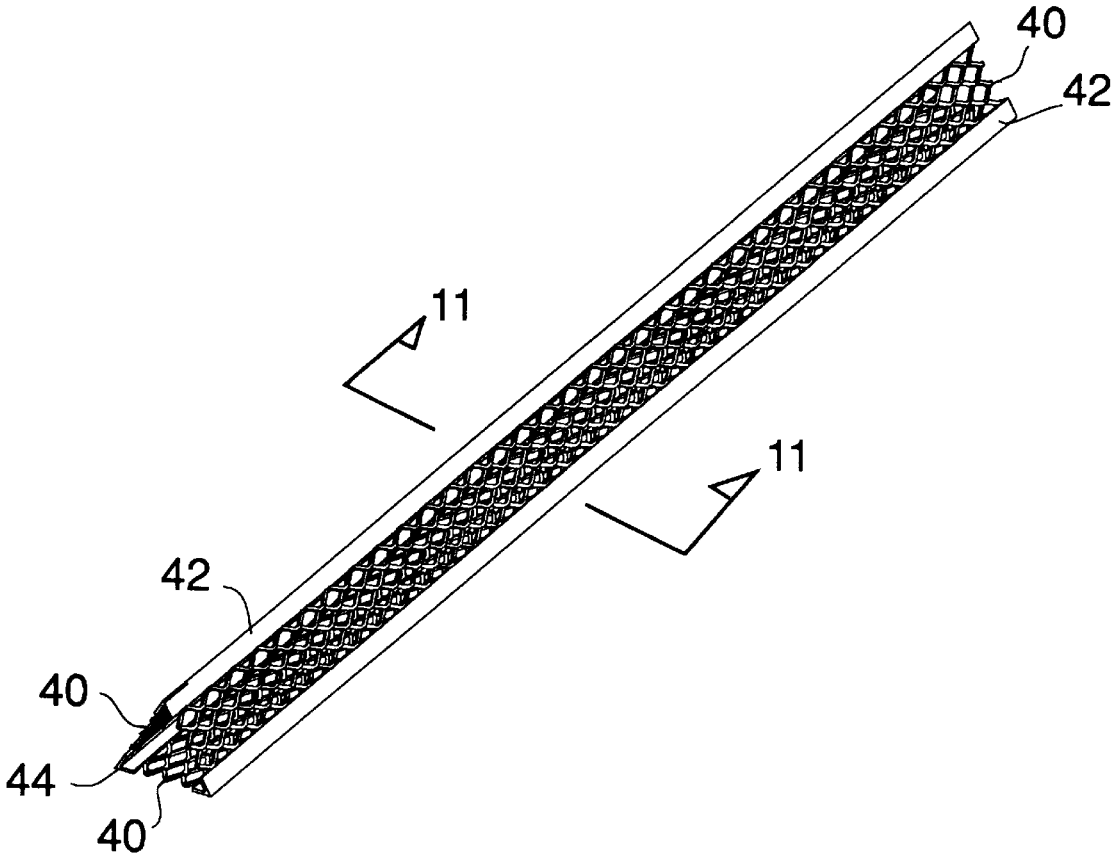
FIG. 10 is a perspective view of another alternative embodiment of the beam of the present invention.
Figure 11:
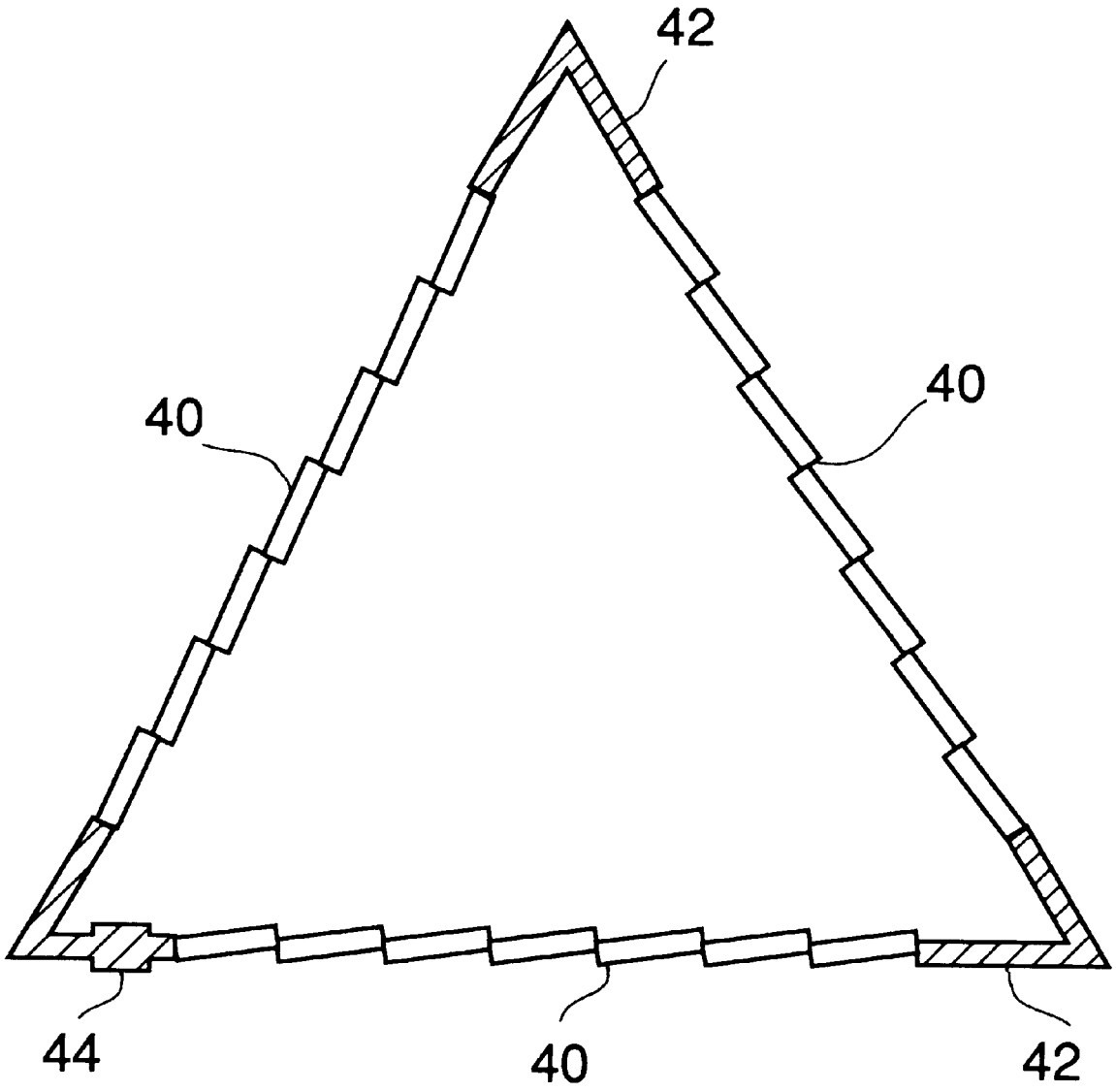
FIG. 11 is a cross-sectional view of FIG. 10 taken along lines 11—11.

FIGS. 10 and 11 illustrate an elongate member coiled from a single piece of sheet metal. The member includes side sections 40 which are integrally attached to each other at respective solid portions 42 in a manner similar to the manner in which the side sections of FIGS. 1 to 3 are integrally attached to each other at respective solid portions. Two of the side sections 40 include respective side edges which are connected at 44 in a manner similar to the folded section 3 of FIG. 3 to form a closed triangular profile. In the embodiment of FIGS. 10 and 11 all of the side sections include expanded metal and the side edges are attached at 44 at a corner of the profile.

Figure 12:
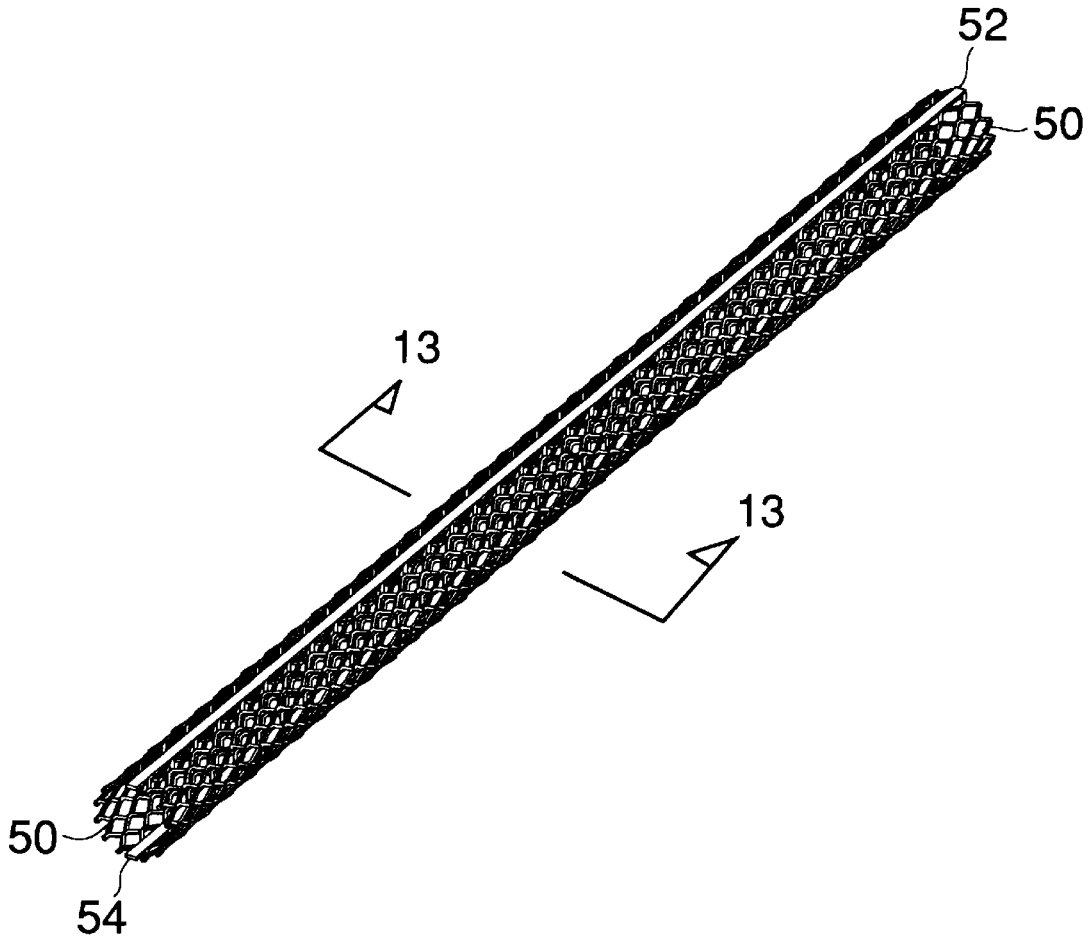
FIG. 12 is a perspective view of another alternative embodiment of the beam of the present invention.
Figure 13:
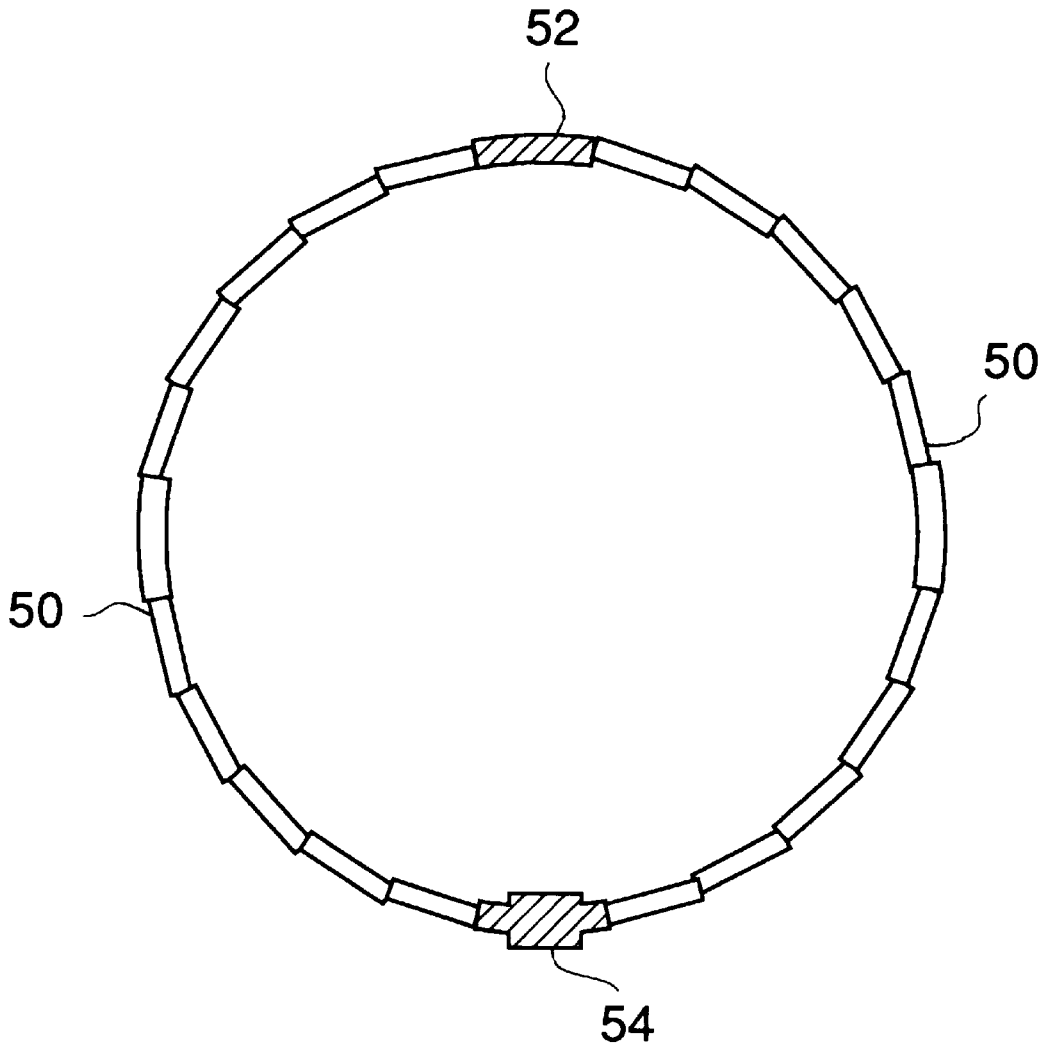
FIG. 13 is a cross-sectional view of FIG. 12 taken along lines 13—13.

The embodiments of FIGS. 12 through 19 are illustrative of elongate beams of the present invention formed from a single sheet of coiled sheet metal and having a first curved side section and a second curved side section that are integrally attached to each other by a solid portion and have side edges which are connected to form a closed profile. Although only two curved side sections are illustrated in FIGS. 12 through 19 more than two side sections may be provided from a single sheet of coiled sheet metal if desired, the additional side sections being integrally connected to an adjacent side section by a solid portion of the sheet, the profile being closed by joined side edges. For example, FIGS. 12 and 13 illustrate an elongate member having two curved side sections 50 which are integrally attached to each other at a solid portion 52 in a manner similar to the manner in which the side sections of FIGS. 1 to 3 are integrally attached to each other at respective solid portions. Side sections 50 also include respective side edges which are connected at 54 in a manner similar to the folded section 3 of FIG. 3 to form a closed circular profile. In the embodiment of FIGS. 12 and 13, the two side sections include expanded metal. One or both of the two curved side sections may include a sheet metal strip including an expanded metal. In the embodiment depicted in FIGS. 12 and 13 both curved side sections include an expanded metal sheet.

Figure 14:
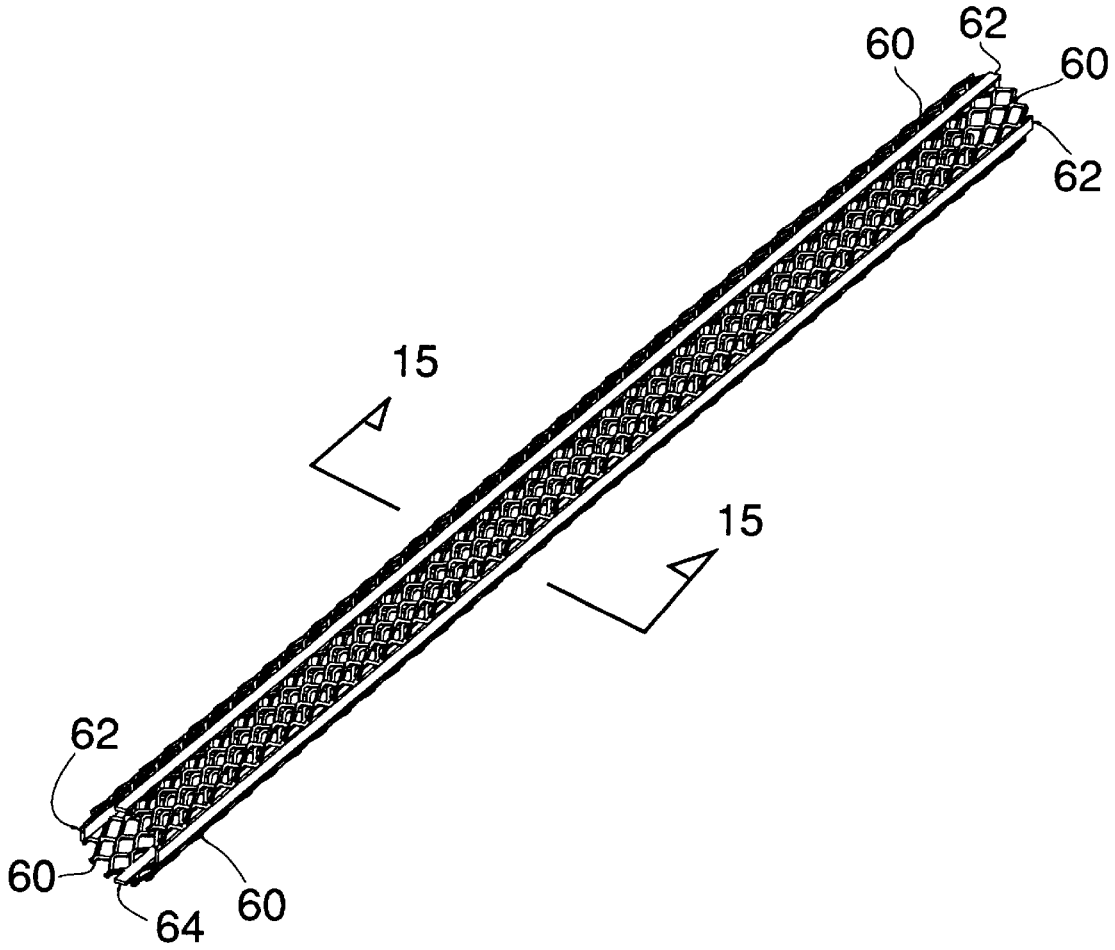
FIG. 14 is a perspective view of another alternative embodiment of the beam of the present invention.
Figure 15:
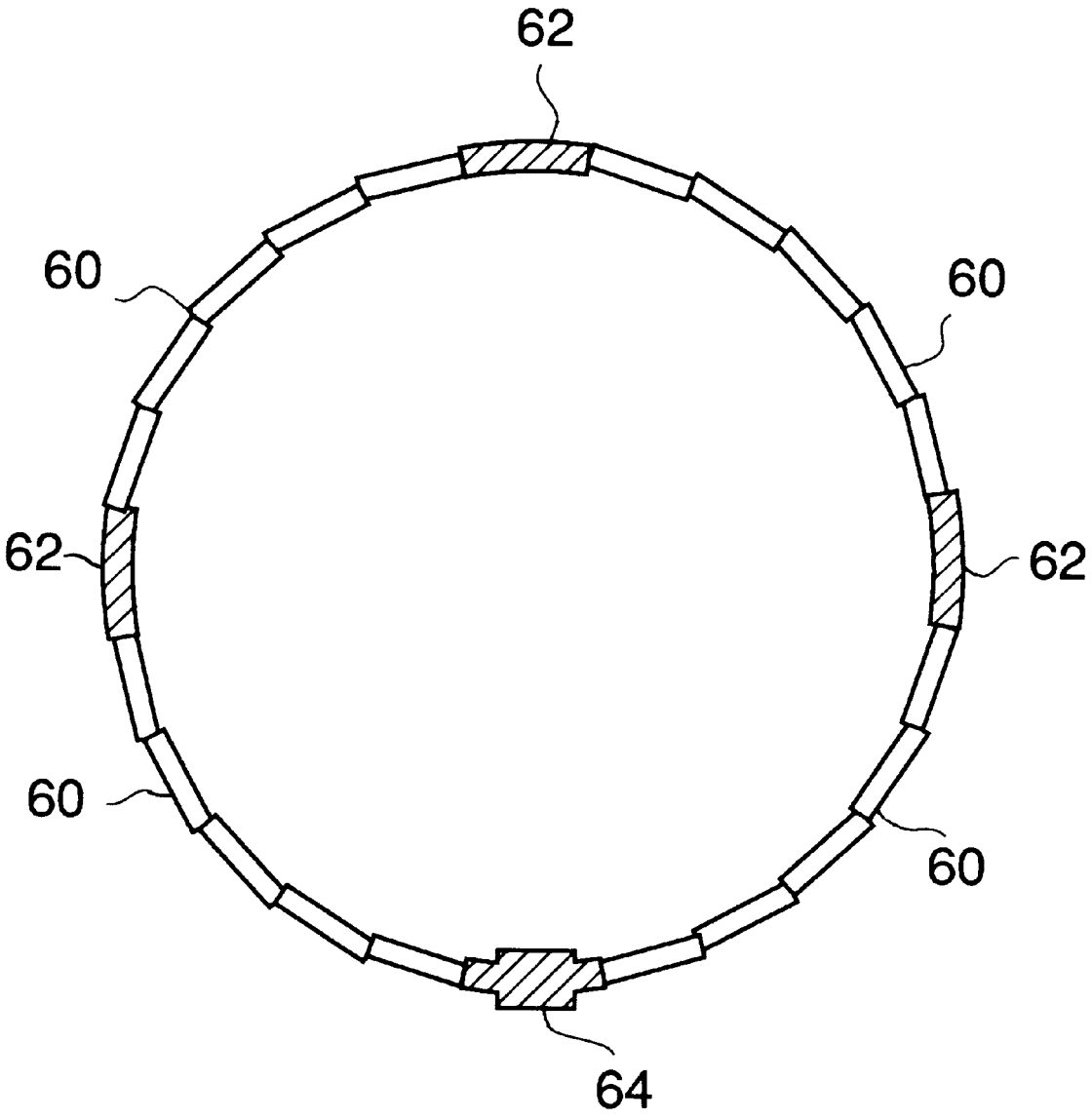
FIG. 15 is a cross-sectional view of FIG. 14 taken along lines 15—15.

FIGS. 14 and 15 illustrate an elongate member having four curved side sections 60 which are integrally attached to each other at a solid portion 62 in a manner similar to the manner in which the side sections of FIGS. 1 to 3 are integrally attached to each other at respective solid portions. Two side sections 60 include respective side edges which are connected at 64 in a manner similar to the folded section 3 of FIG. 3 to form a closed circular profile. In the embodiment of FIGS. 14 and 15, all of the side sections include expanded metal.

Figure 16:
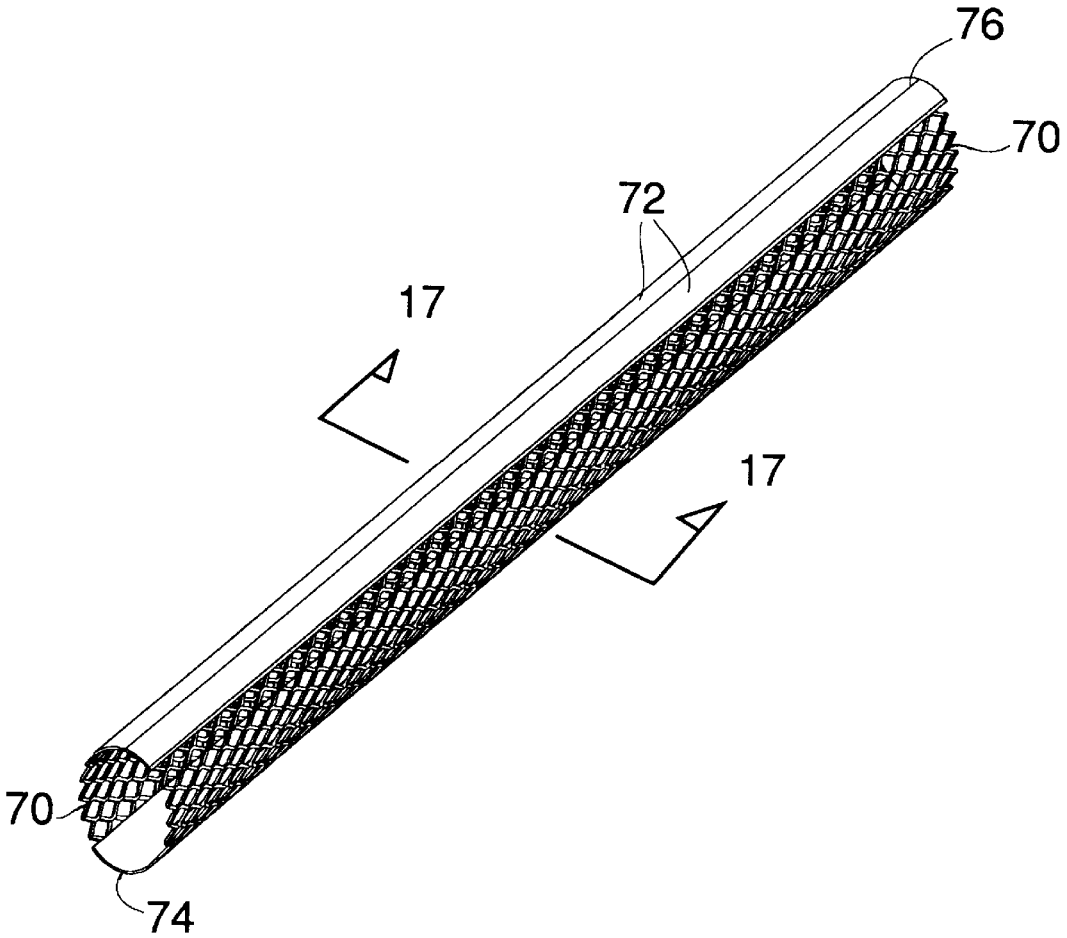
FIG. 16 is a perspective view of another alternative embodiment of the beam of the present invention.
Figure 17:
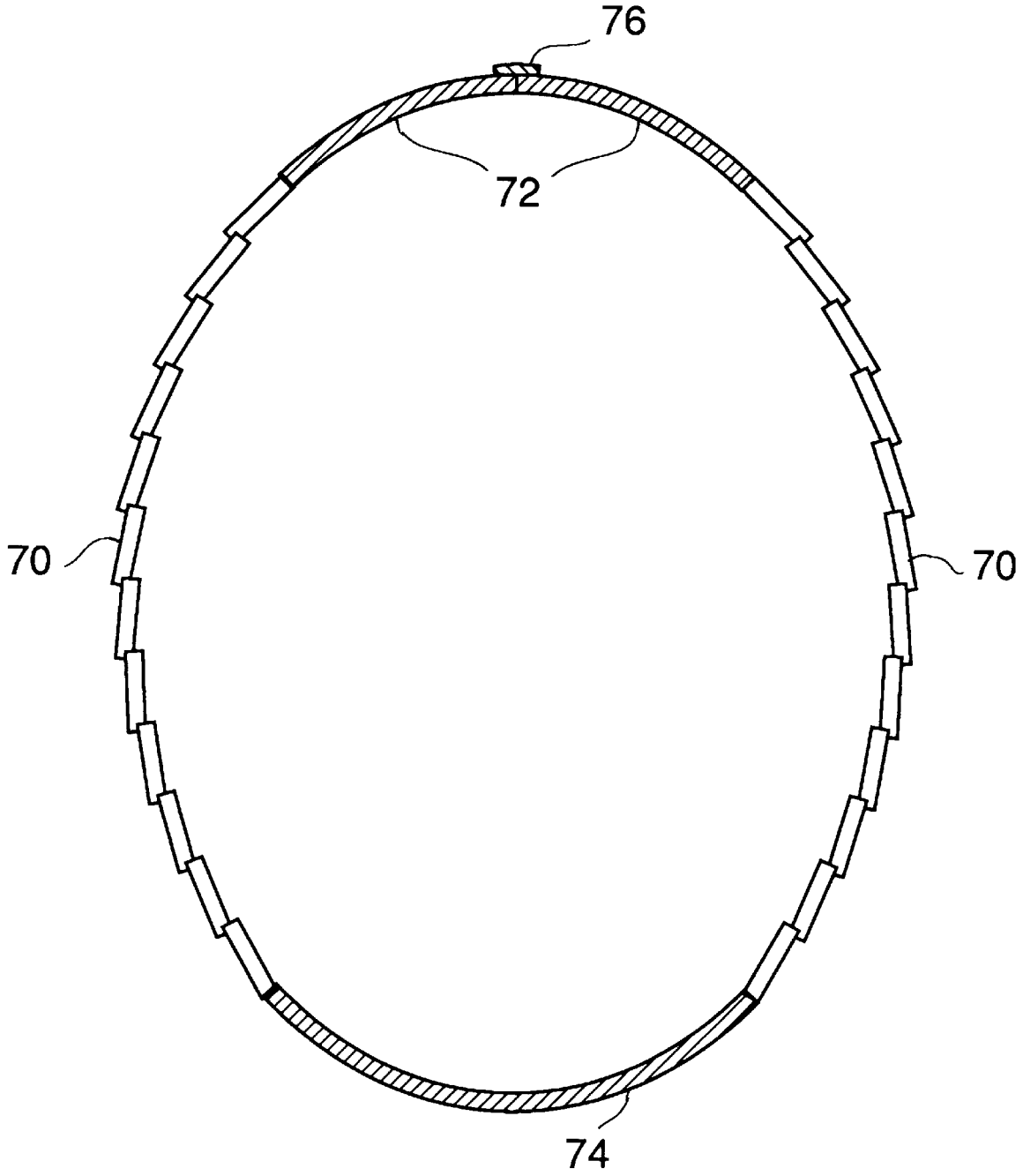
FIG. 17 is a cross-sectional view of FIG. 16 taken along lines 17—17.

FIGS. 16 and 17 illustrate an elongate member having two curved side sections 70 which include expanded metal and two curved side sections 72, 74 which are unbroken sections; that is, solid portions. In this embodiment, the side sections 70 are integrally attached to each other by an extended solid portion 74 in a manner similar to the manner in which the side sections of FIGS. 1 to 3 are integrally attached to each other at respective solid portions. Side sections 70 also include respective unbroken side edges which are connected at 76 in a manner similar to the folded section 3 of FIG. 3 to form a closed oval profile.

Figure 18:
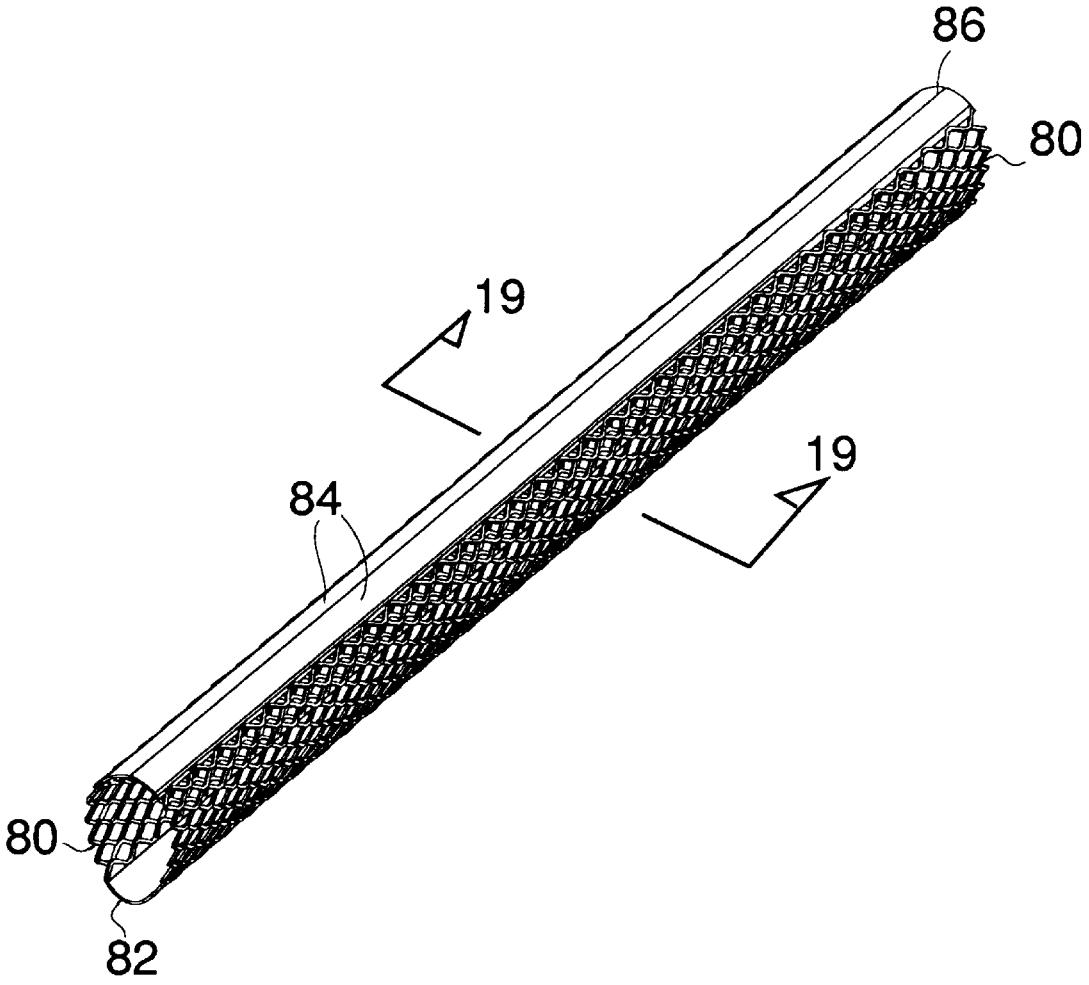
FIG. 18 is a perspective view of another alternative embodiment of the beam of the present invention.
Figure 19:
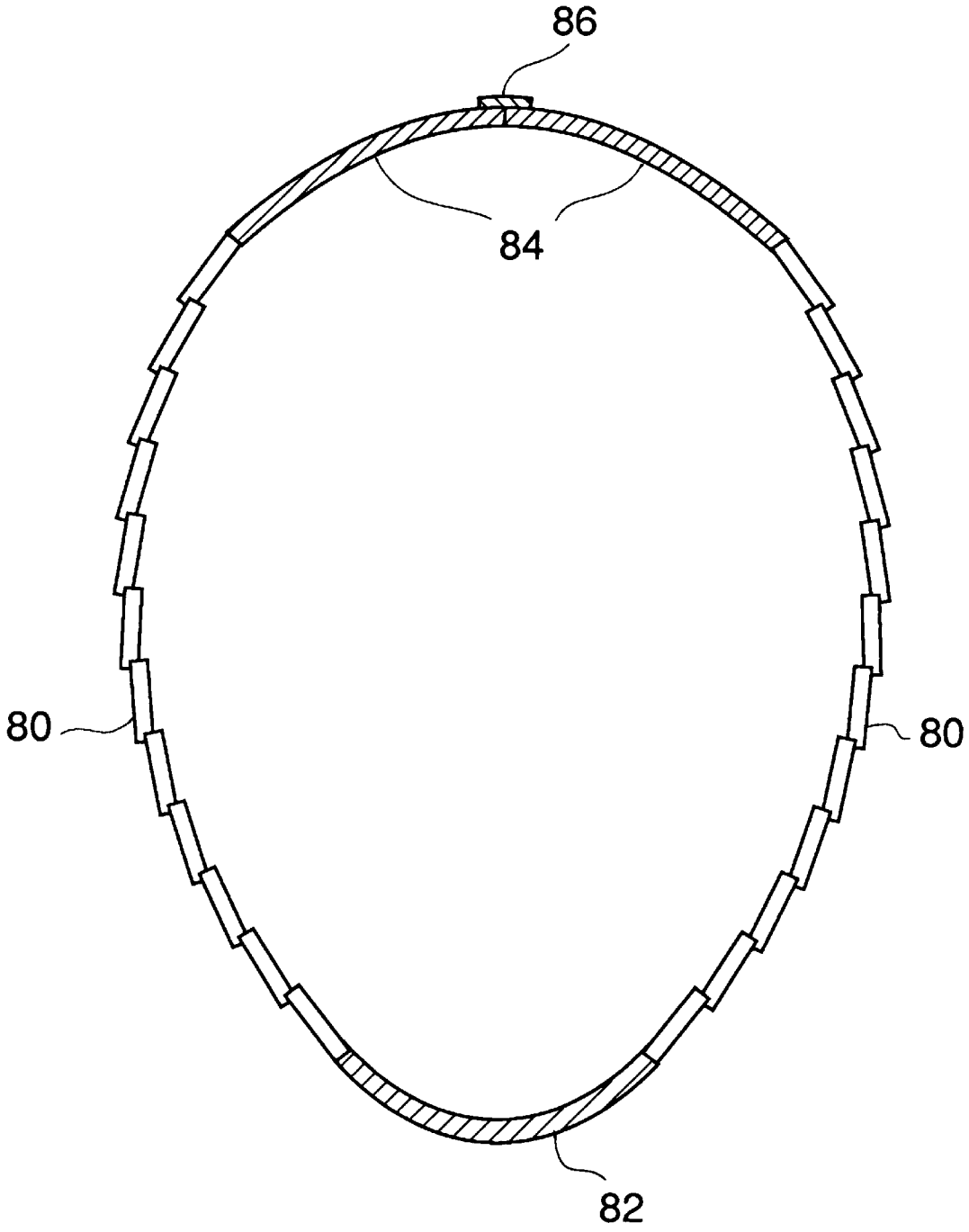
FIG. 19 is a cross-sectional view of FIG. 18 taken along lines 19—19.

FIGS. 18 and 19 illustrate an elongate member having two curved side sections 80 which include expanded metal and two curved side sections 82, 84 which are unbroken or solid as in the embodiment of FIGS. 16 and 17. In this embodiment, the side sections 80 are integrally attached to each other by an extended solid portion 82 in a manner similar to the manner in which the side sections of FIGS. 1 to 3 are integrally attached to each other at respective solid portions. Side sections 80 also include respective side edges which are connected at 86 in a manner similar to the folded section 3 of FIG. 3 to form a closed elliptic profile.

Figure 20:
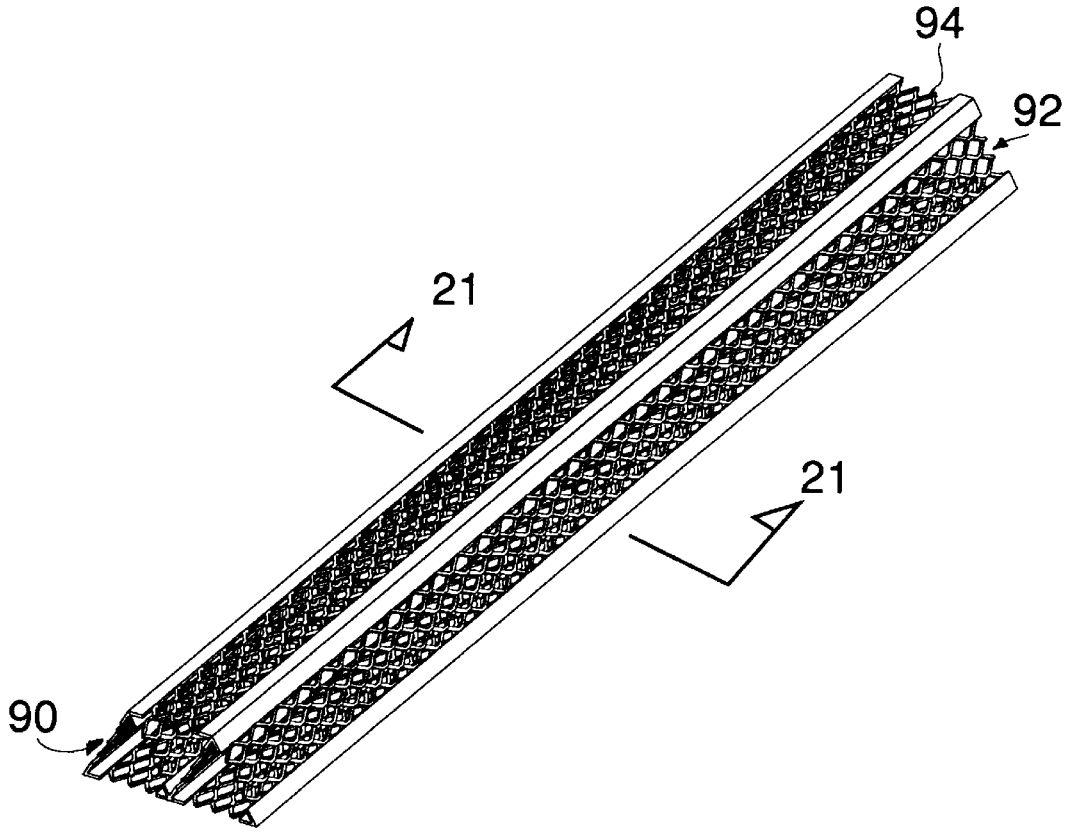
FIG. 20 is a perspective view of another alternative embodiment of the beam of the present invention.
Figure 21:
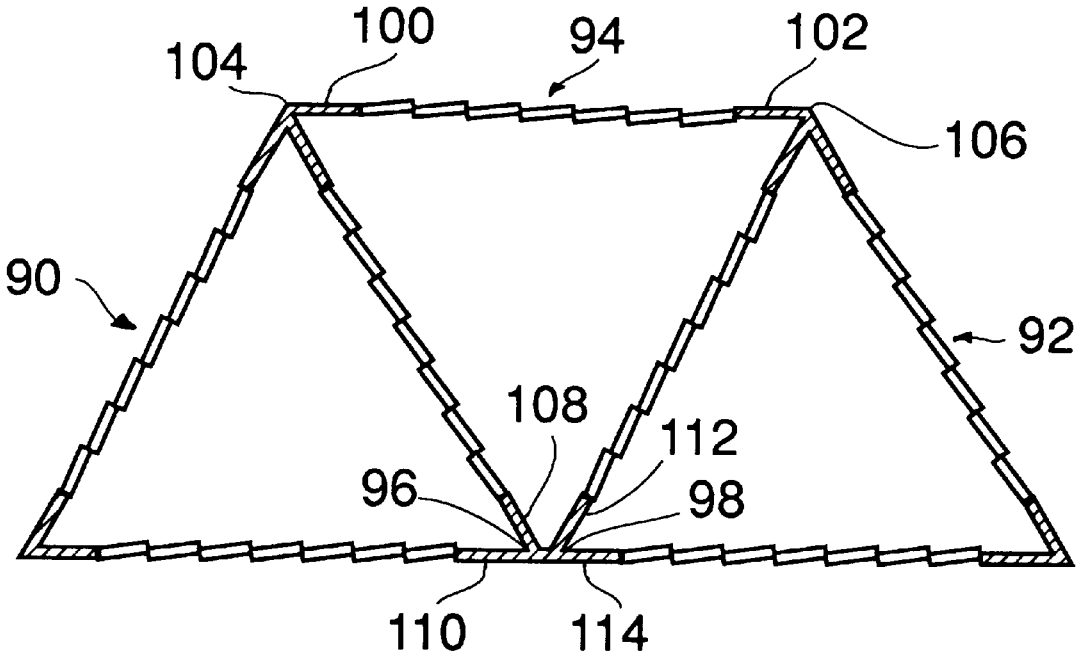
FIG. 21 is a cross-sectional view of FIG. 20 taken along lines 21—21.

FIGS. 20 and 21 illustrate an elongated member which may be fabricated from two closed elongated triangular profiles 90, 92, each formed from a single sheet of coiled material, and a length of sheet material 94 extending therebetween to form an elongated closed profile having a triple-triangular profile. The elongated profiles 90 and 92 may be two triangular profiles, each similar to the triangular profile illustrated in FIGS. 10 and 11, profiles 90 and 92 being welded together at respective tips or apexes 96 and 98, and welded to the side edges 100 and 102 of the length of sheet material 94 at respective tips or apexes 104 and 106. The connected side edges of the profile 90, and the connected side edges of the profile 92, may be connected in a manner similar to the folded section 3 of FIG. 3 to form the respective closed triangular profiles 90 and 92, and such connected areas may be at any of the tips or apexes of the closed triangular profiles 90 and 92. However, in the embodiment illustrated in FIGS. 20 and 21, the profile 90 includes side edges 108 and 110 which are welded together at tip 96 to form the closed triangular profile 90, and the profile 92 includes side edges 112 and 114 which are welded together at tip 98 to form the closed triangular profile 92.

Figure 22:
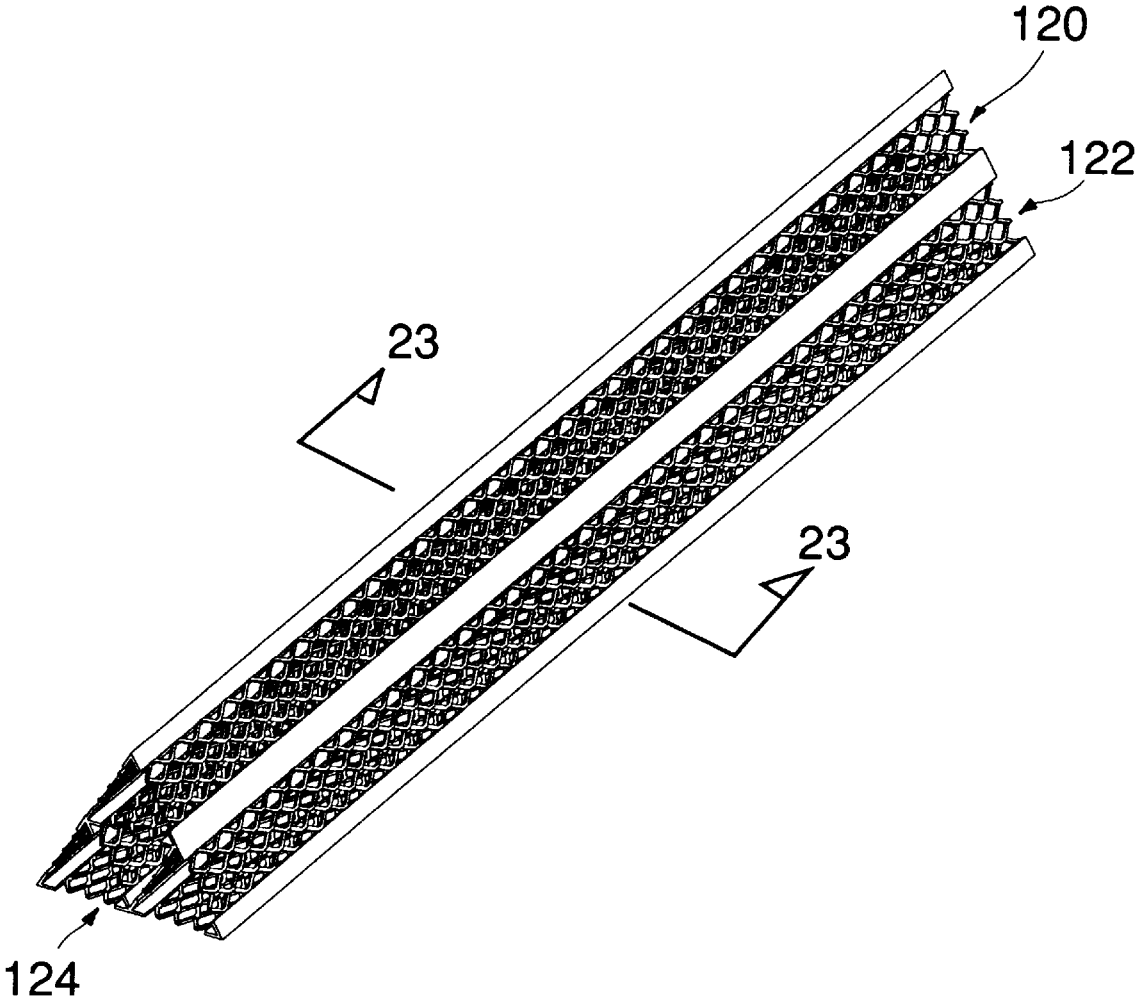
FIG. 22 is a perspective view of another alternative embodiment of the beam of the present invention.
Figure 23:
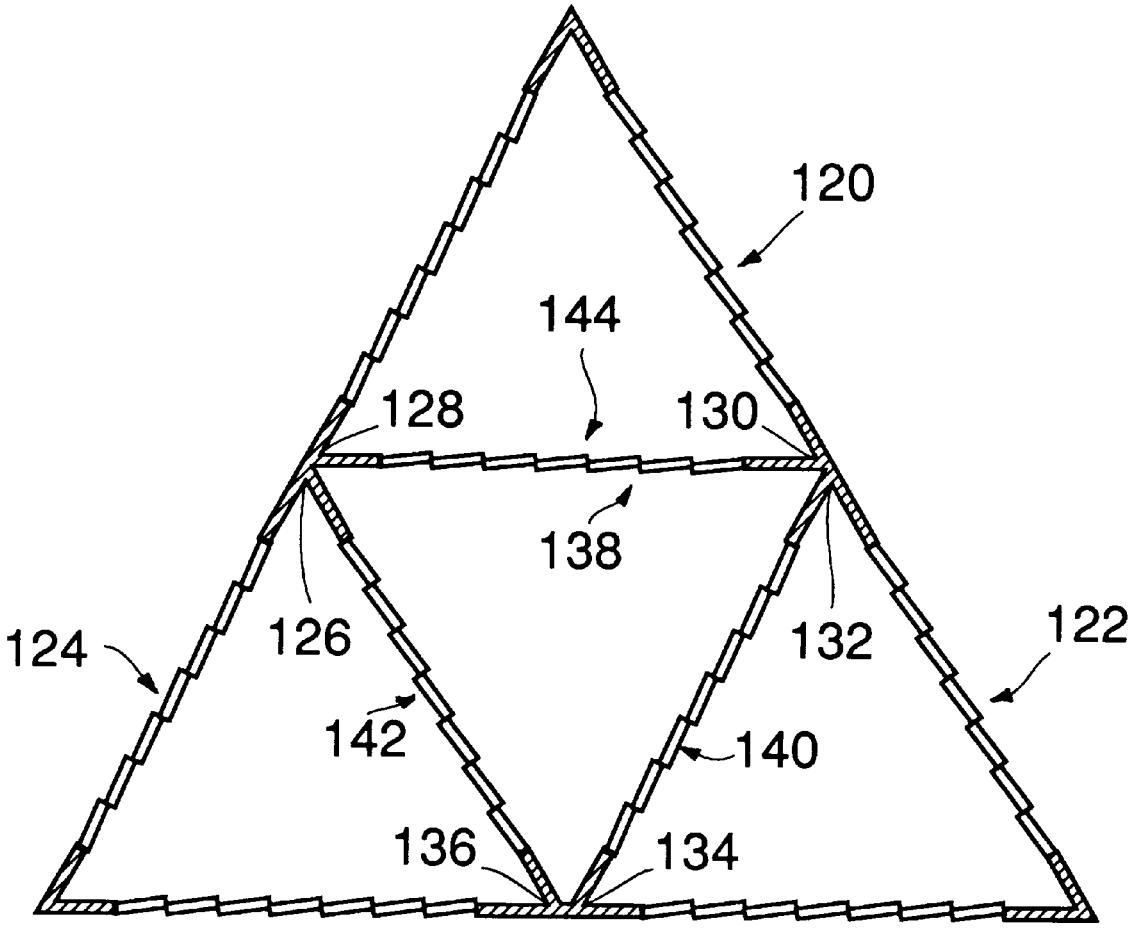
FIG. 23 is a cross-sectional view of FIG. 22 taken along lines 23—23.
Figure 24:
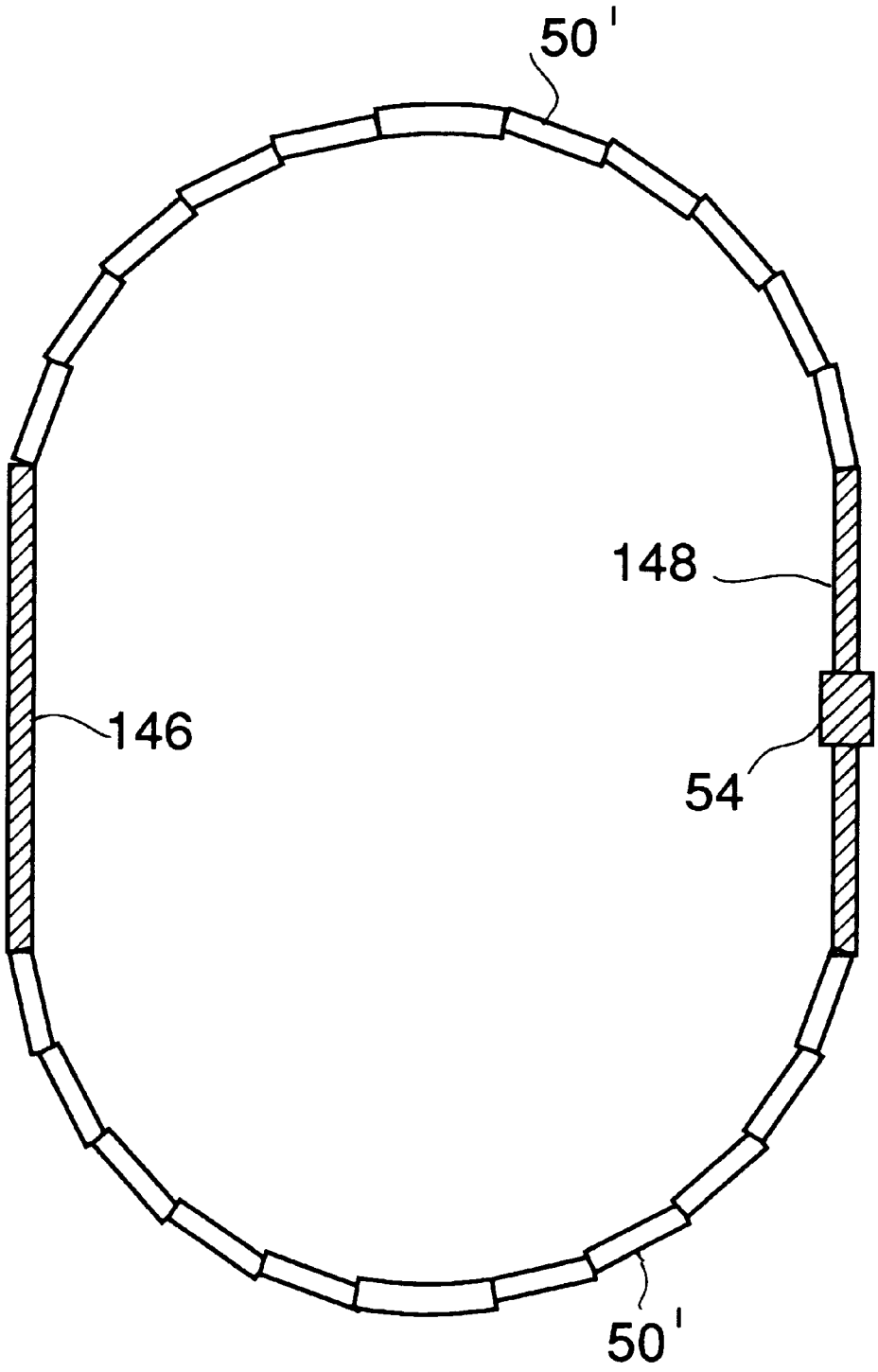
FIG. 24 is a cross-sectional view of another alternative embodiment of the beam of the present invention.

FIGS. 22 and 23 illustrate an elongated member which may be fabricated from three closed elongated triangular profiles 120, 122 and 124 which may be welded to each other at tips 126 and 128, tips 130 and 132, and tips 134 and 136, to form an elongated closed profile having a tetragon-triangular profile wherein side sections 138, 140 and 142 of respective profiles 120, 122 and 124 form a fourth closed elongated triangular profile 144. Profiles 120, 122 and 124 are each formed from a respective single sheet of coiled material. Each of the profiles 120, 122 and 124 may be similar to the triangular profiles illustrated in FIGS. 10 and 11. The connected side edges of the profiles 120, the connected side edges of the profile 122, and the connected side edges of the profile 124, may be connected in a manner similar to the folded sections 3 of FIG. 3, or in a manner similar to the welded tips of FIGS. 20 and 21, to form the respective closed triangular profiles 120, 122 and 123, and such connected areas may be at any of the tips of the closed triangular profiles 120, 122 and 124. However, like the embodiment of FIGS. 20 and 21, in the embodiment illustrated in FIGS. 22 and 23, the profile 120 includes side edges which are welded together at tip 128 to form the closed triangular profile 120, the profile 122 includes side edges which are welded together at tip 132 to form the closed triangular profile 122, and the profile 124 includes such edges which are welded together at tip 136 to form the closed triangular profile 124. FIG. 24 illustrates a cross section of the beam of the present invention similar to the beam depicted in FIGS. 12 and 13. FIG. 24 is similar to the cross-section of FIG. 13 with the exception that the width 56 of the solid portion 52 has been increased to provide a solid straight side section 146, and the width 58 of the respective side edges which are connected at 54 is increased to provide a second solid straight side section 148 which is parallel to the section 146. The curved side sections 50' are identical to the curved side sections 50 of FIGS. 12 and 13. One or both of the two curved side sections may include a sheet metal strip including an expanded metal. In the embodiment depicted in FIG. 24 both curved side sections include an expanded metal sheet.

Figure 25:
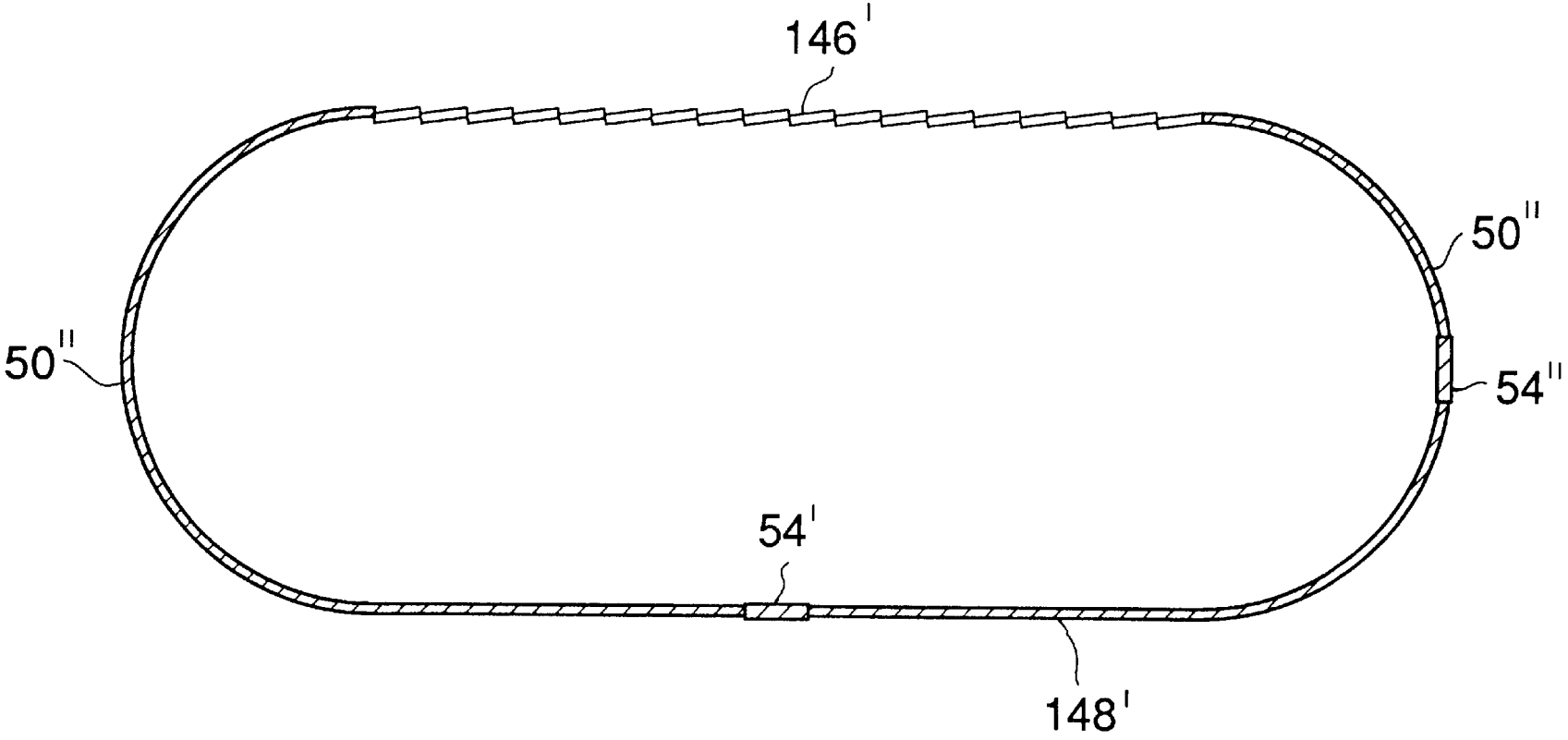
FIG. 25 is a cross-sectional view of another alternative embodiment of the beam of the present invention.

FIG. 25 illustrates a cross-section of the beam of the present invention similar to the cross-section of FIG. 24 with the exception that the two curved side sections 50" are made of solid material and at least one of the parallel straight side sections 146' and 148' includes an expanded metal. In the embodiment of FIG. 25, straight side section 146' includes an expanded metal and straight side section 148' is made of solid material. The side edges of the profile are connected at 54' in a manner similar to the folded section 3 of FIG. 3. In the event that straight side sections 146' and 148' include an expanded metal, the respective side edges may be positioned within the length of one of the solid curved side sections 50" and connected at 5411 in a manner similar to the folded section 3 of FIG. 3 to form.

Figure 26:
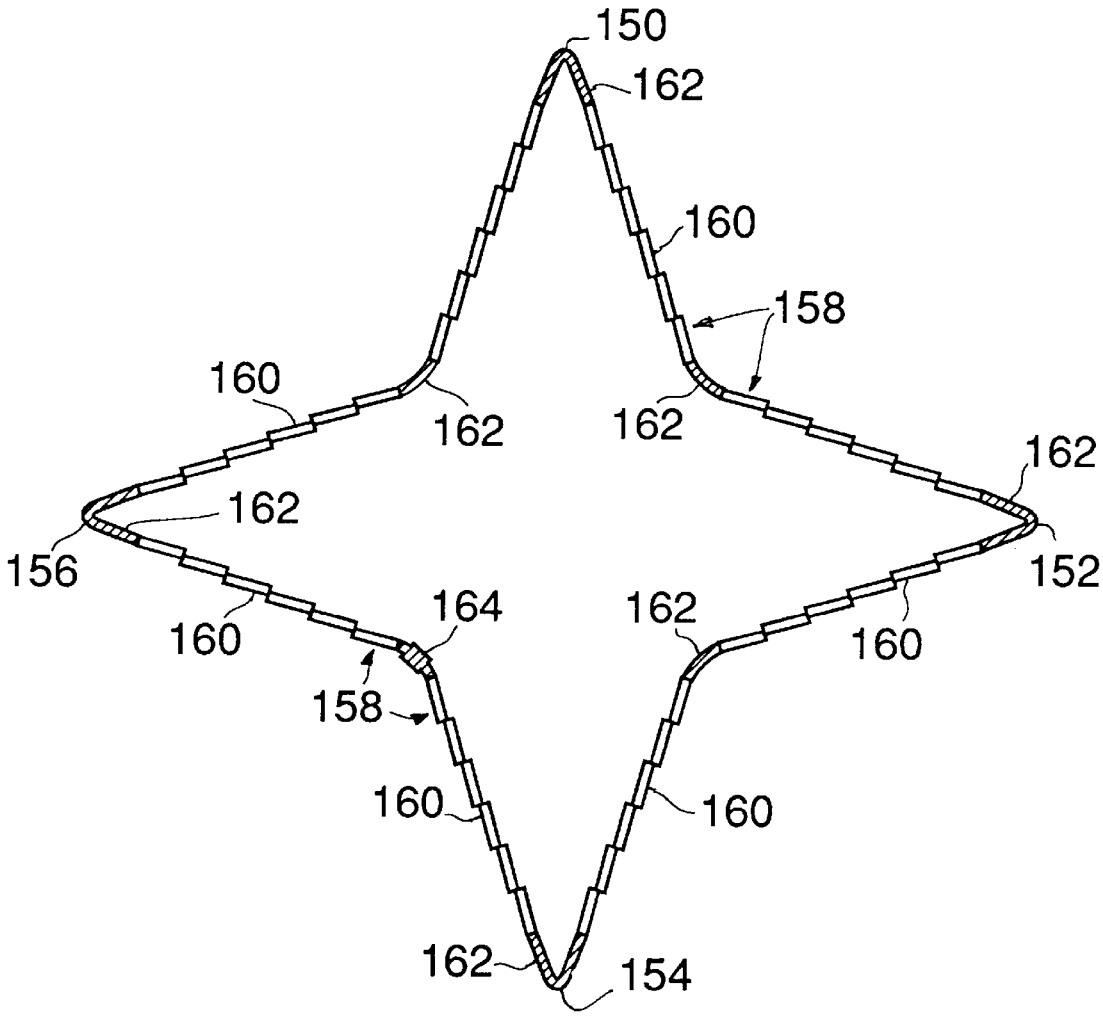
FIG. 26 is a cross-sectional view of another alternative embodiment of the beam of the present invention.

FIG. 26 illustrates a cross-section of an embodiment of the beam of the present invention illustrating a profile which is star-shaped. Although the number of points of the star-shaped beam may vary, in the embodiment illustrated in FIG. 26 there are four points 150, 152, 154 and 156. Without limitation, in the embodiment of FIG. 26, each section 158 of the beam includes side sections 160 which include expanded metal sheet and solid portions 162 which integrally join adjacent sections 160, although two of the adjacent sections 160 include side edges which are connected at 164 in a manner similar to the folded section 3 of FIG. 3 to form the closed star-shaped profile. The beam of FIG. 26 is made of a single piece of sheet material which may be folded into the illustrated profile.

Figure 27:
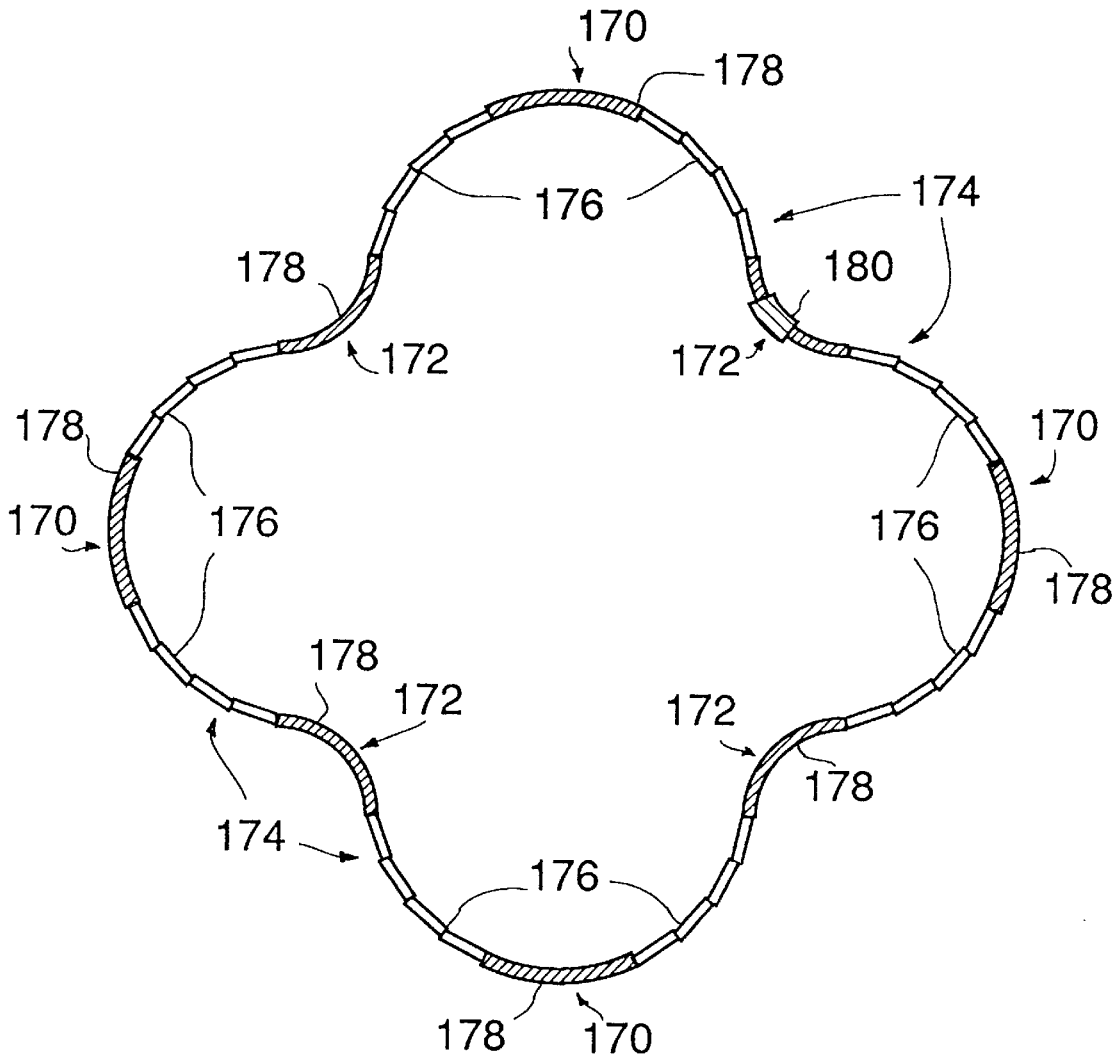
FIG. 27 is a cross-sectional view of another alternative embodiment of the beam of the present invention.

FIG. 27 illustrates a cross-section of an embodiment of the beam of the present invention having a profile which is corrugated. Although the number of corrugations of the beam may vary, in the embodiment illustrated in FIG. 27 there are four outer apexes 170 and four inner apexes 172 which collectively form four sections 174. Each section 174 includes side sections 176 which include expanded metal sheet and solid portions 178 which integrally join adjacent sections 176, although two of the adjacent sections 176 include side edges which are connected at 180 in a manner similar to the folded section 3 of FIG. 3 to form the closed corrugated-shaped profile. The beam of FIG. 27 is made of a single piece of sheet material which may be folded into the illustrated profile.

It will be apparent from the foregoing that the beam of the present invention does not need to exhibit sections of expanded metal on all sides, but that it may be appropriate in certain cases to have expanded metal on one or two sides, for example two opposing sides, or on two or three adjacent sides of a quadrangular beam. It is also possible to have a beam, such as an oval beam, in which one side exhibits a section of expanded metal, whereas the other side is unbroken. The unbroken edge sections may be provided with sections of expanded metal or holes intended to lighten the structure.

The sheet metal from which a beam in accordance with the present invention is manufactured may consist of many different materials, for example aluminum, or steel etc.

A beam in accordance with the present invention can be manufactured in an expander, which makes it possible to achieve sections of expanded metal that are separated by unbroken sections of sheet metal, in conjunction with which a profiling machine and a folding machine or a welding machine are positioned directly after the expander in question. The profiling machine and the folding machine or the welding machine may be separate machines from the expander.

A beam in accordance with the present invention will exhibit sufficiently good strength characteristics, and may be manufactured at such low cost that it will be capable of being used within the construction industry as a load-bearing structural beam, where it can replace the wooden beams of both small and large dimensions used today.

BUSINESS IDEA

Self-contained profiles of expanded metal and unperforated plate are manufactured from a coil of sheet metal strip. Expanded metal profiles with edges and/or strips of unperforated plate are roller-formed. The invention allows manufacturing of a large quantity of products.

APPLICATIONS

Noted below are examples of applications of the beam of the present invention:

pillars and beams for building constructions;

containers and buildings in steel and aluminum, for example building platform accommodation;

energy-absorbing supporting structures for road equipment, for example light columns;

furniture frames;

tubular structures;

cable support system and protection (shielding), refining elements and diffusers, etc.;

insulation of tunnels for noise absorption;

impact safety in the design of motor vehicles; and rib frames, for example in lightweight boats.

PROPERTIES

Noted below are examples of the properties of the beam of the present invention:

low weight;

low energy transmission (noise and heat);

high energy absorption by deformation;

low-cost, rapid production in large quantities;

simple perforation and jointing, etc.; and flexibility of design and product qualities.

GENERAL

Machine investment cost depends on the thickness of the metal strip, the width of the metal strip and the post-production equipment.

A rotary expander has high production capacity.

Each unit can be produced at a lower cost compared to a profile made from, untreated metal strip of the same plate thickness.

Processing and material savings give the product a surplus.

The invention offers wide scope for giving each product the specific qualities demanded.

The technique is today best suitable for metal strip of up to 3–5 mm in thickness.

MANUFACTURING PROCESS

The aforementioned profiles can be manufactured in a straight line from one or more coils of sheet metal strip. A production line can consist of a rotary expander, a roller-former and, for example, a high-frequency (HF) welding machine and/or an edge folder followed by a cross-cutting machine. Sections of the metal strip are expanded in the rotary expander. Areas of unperforated metal are left between the expanded areas. A self-contained profile, for example round or square, is shaped in the roller-former. The unperforated area forms the edges in cornered profiles. The profiles are sealed, for example, with a weld and/or a folded seam. If a folded seam is chosen, the seam is produced in the roller-forming process. Without limitation, a welded seal may be made as in the case of tube manufacturing, and the manufacturing of triple-triangular and tetragon-triangular profiles, using an HF weld. Other methods of profile sealing can be used.

Many modifications are conceivable, of course, within the scope of the idea of invention defined in the following claims.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A beam having a closed profile, comprising:

an elongate member having at least a first curved side section and a second curved side section that is integrally attached to the first curved side section by a first solid portion, at least one of the first curved side section and the second curved side section including a sheet metal strip including an expanded metal; and the elongate member having a first side edge connected to a second side edge to form a closed profile.

2. The beam of claim 1 (*a*) wherein said first solid portion is constructed and arranged to form a first solid straight side section; and (*b*) wherein said first side edge and said second side edge are adjacent said first curved side section and said second curved side section, respectively, and are constructed and arranged to form a second solid straight side section parallel to said first solid straight side section.

3. The beam of claim 1 wherein said first curved side section and said second curved side section each include a sheet metal strip including an expanded metal.

4. The beam of claim 1 wherein said profile is an ellipse.

5. The beam of claim 1 wherein said profile is an oval.

6. The beam of claim 1 wherein said profile is a circle.

7. The beam of claim 6 further including a third curved side section that is integrally attached to said second curved side section by a second solid portion and a fourth curved side section that is integrally attached to said third curved section by a third solid portion.

8. The beam of claim 7 wherein said first curved side section, said second curved side section, said third curved side section and said fourth curved side section each include a sheet metal strip including an expanded metal.

9. The beam of claim 1, wherein said first solid portion is constructed and arranged to form a first curved solid portion; and wherein said first side edge and said second side edge are adjacent said first curved side section and said second curved side section, respectively, and are constructed and arranged to form a second curved solid portion.

10. The beam of claim 9 wherein said first curved side section and said second curved side section each include a sheet metal strip including an expanded metal.

11. The beam of claim 9 wherein said profile is an ellipse.

12. The beam of claim 9 wherein said profile is an oval.

13. The beam of claim 9, wherein said profile is a circle.

* * * * *